US008061096B2

(12) United States Patent
Kim et al.

(10) Patent No.: US 8,061,096 B2
(45) Date of Patent: Nov. 22, 2011

(54) REINFORCEMENT DEVICE FOR COMPRESSION BUCKLING STRENGTH AND METHOD OF FASTENING THE SAME

(75) Inventors: Kang Sik Kim, Daejeon (KR); Ki Joo Kwon, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 39 days.

(21) Appl. No.: 12/559,153

(22) Filed: Sep. 14, 2009

(65) Prior Publication Data

US 2010/0132300 A1 Jun. 3, 2010

(30) Foreign Application Priority Data

Sep. 26, 2008 (KR) ..... 10-2008-0094654

(51) Int. Cl.
*E04G 23/00* (2006.01)

(52) U.S. Cl. ..... 52/291; 52/223.14; 52/170; 52/834; 248/228.1; 248/226.11

(58) Field of Classification Search ..... 52/170, 52/834, 835, 836, 223.8, 223.14, 223.4, 231, 52/291; 248/226.11, 228.1, 228.6, 218.4, 248/219.3, 219.4
See application file for complete search history.

(56) References Cited

U.S. PATENT DOCUMENTS

| | | | | |
|---|---|---|---|---|
| 677,090 | A * | 6/1901 | Lanz | 52/170 |
| 1,489,474 | A * | 4/1924 | Beckwith | 52/489.1 |
| 2,664,636 | A * | 1/1954 | Schneider et al. | 33/406 |
| 3,483,992 | A * | 12/1969 | Fournier | 210/497.1 |
| 3,738,072 | A * | 6/1973 | Adrian | 52/170 |
| 4,034,535 | A * | 7/1977 | Dustmann | 52/834 |
| 5,974,744 | A * | 11/1999 | Guilbeault | 52/170 |
| 6,151,860 | A * | 11/2000 | Reisdorff | 52/651.02 |
| 6,334,285 | B1 * | 1/2002 | Kirschner | 52/702 |
| 6,454,232 | B1 * | 9/2002 | Roth | 248/228.1 |
| 6,922,953 | B1 * | 8/2005 | Lewis | 52/126.1 |
| 7,284,728 | B2 * | 10/2007 | Connolly | 248/62 |
| 2002/0096617 | A1 * | 7/2002 | Marcotte et al. | 248/548 |
| 2002/0112441 | A1 * | 8/2002 | Bissen | 52/736.1 |
| 2007/0084137 | A1 * | 4/2007 | Pasto | 52/170 |
| 2009/0152419 | A1 * | 6/2009 | Wallace | 248/219.4 |
| 2009/0230266 | A1 * | 9/2009 | Hillstrom et al. | 248/230.9 |

FOREIGN PATENT DOCUMENTS

JP 11-071857 3/1999

(Continued)

*Primary Examiner* — Robert Canfield
*Assistant Examiner* — Babajide Demuren
(74) *Attorney, Agent, or Firm* — McDermott Will & Emery LLP

(57) ABSTRACT

A reinforcement device for compression buckling strength and a method of fastening the same are disclosed. The reinforcement device includes a member seating body surrounding an angle-type steel-frame member, first and second securing couplers securing opposite ends of the angle-type steel-frame member and opposite ends of the member seating body and adjustable to meet a standard of the angle-type steel-frame member, a horizontal engaging element connecting the first and second securing couplers with each other, a supporter positioned in a space where the angle-type steel-frame to member forms a right angle and supporting the angle-type steel-frame member, and a reinforcing bar connecting the supporter and the horizontal engaging element. The reinforcement device prevents an angle-type steel-frame member for a steel-frame structure or a steel power-transmission tower from undergoing compression buckling and accidental eccentricity, and improves compression buckling strength without power interruption of transmission lines, member disassembly, or field preparation.

11 Claims, 7 Drawing Sheets

FOREIGN PATENT DOCUMENTS

| | | | | |
|---|---|---|---|---|
| JP | 2007-332549 | 12/2007 | | |
| JP | 2008-184883 | 8/2008 | | |
| JP | 2010024747 A | * | 2/2010 | |
| KR | 20-0362177 | | 9/2004 | |

* cited by examiner

REINFORCEMENT DEVICE FOR COMPRESSION BUCKLING STRENGTH AND METHOD OF FASTENING THE SAME

BACKGROUND OF THE INVENTION

1. Field of the Invention

The present invention relates to a reinforcement device for compression buckling strength and a method of fastening the same, which can improve compression buckling strength in a detachable manner, without power interruption of transmission lines, member disassembly or field preparation, so as to prevent an angle-type steel-frame member for a steel-frame structure or a steel power-transmission tower from undergoing compression buckling and accidental eccentricity.

2. Description of the Related Art

In general, a steel power-transmission tower has a truss structure, which is designed to connect steel-frame members triangularly and use tension and compressive force of the members to resist external force. Since the truss structure enables construction of a lightweight and rigid structure, it is believed to be effective against earthquakes. Here, an angle-type steel-frame member is employed not only as the steel-frame member for the steel power-transmission tower having the truss structure, but also as a brace for resisting lateral force in the steel-frame structure.

However, since the angle-type steel-frame members are vulnerable to compression buckling and accidental eccentricity, the angle-type steel-frame members are liable to fall in succession if an unexpected typhoon, strong wind or the like causes any one member to buckle. Thus, it is very important to manage straightness and partial distortion of the member.

Referring to FIG. 1, if a post of an angle-type steel-frame member is longer than a cross section thereof, the angle-type steel-frame member (an L-shaped steel corner post) receives a compressive load at opposite ends thereof and suddenly buckles when the load reaches a predetermined level.

For this reason, replacement of the steel-frame member with one having a large cross-sectional area or attachment of a plate thereto using a bolt has been suggested to reinforce the angle-type steel-frame member. However, for the steel power-transmission tower, these methods have problems in that many processes such as stoppage of power supply, member disassembly, preparation for reinforcement, and so on are needed. Further, conventional reinforcement operation for the angle-type steel-frame member requires various preceding operations, such as transmission line bypass, working diagram preparation, work-plan establishment, and the like, which consume considerable time and expenses.

SUMMARY OF THE INVENTION

Therefore, the present invention is directed to solving the above and other problems of the related art, and an aspect of the invention is to provide a reinforcement device for compression buckling strength and a method of fastening the same, which can improve compression buckling strength in a detachable manner without power interruption of transmission lines, member disassembly or field preparation, so as to prevent an angle-type steel-frame member for a steel-frame structure or a steel power-transmission tower from undergoing compression buckling and accidental eccentricity.

In accordance with an aspect, the invention provides a reinforcement device for compression buckling strength including: a member seating body surrounding an angle-type steel-frame member; first and second securing couplers securing opposite ends of the angle-type steel-frame member and opposite ends of the member seating body, the first and second securing couplers being adjustable to meet a standard of the angle-type steel-frame member; a horizontal engaging element connecting the first and second securing couplers with each other; a supporter positioned in a space where the angle-type steel-frame member forms a right angle and supporting the angle-type steel-frame member; and a reinforcing bar connecting the supporter and the horizontal engaging element.

The member seating body may have an L-shape or an inverse-L shape to surround the angle-type steel-frame member.

The first securing coupler may include a first hole into which one end of the member seating body is inserted; a second hole into which one end of the horizontal engaging element is inserted; and a first groove into which one end of the angle-type steel-frame member is inserted.

The first securing coupler may further include a first round-bar engaging member securing one end of the member seating body inserted into the first hole of the first securing coupler; a second round-bar engaging member securing one end of the horizontal engaging element inserted into the second hole of the first securing coupler; and a first securing bolt securing one end of the angle-type steel-frame member inserted into the first groove of the first securing coupler.

The first securing coupler may include a first straddle groove on which one end of the member seating body is straddled; a second straddle groove on which one end of the horizontal engaging element is straddled; and a first groove in which one end of the angle-type steel-frame member is inserted.

The second securing coupler may include a third hole into which the other end of the member seating body is inserted and secured; a fourth hole into which the other end of the horizontal engaging element is inserted; and a second groove into which the other end of the angle-type steel-frame member is inserted.

The first securing coupler may further include a third round-bar engaging member securing one end of the member seating body inserted into the third hole of the second securing coupler; a fourth round-bar engaging member securing one end of the horizontal engaging element inserted into the fourth hole of the second securing coupler; and a second securing bolt securing one end of the angle-type steel-frame member inserted into the second groove of the second securing coupler.

The second securing coupler may include a third straddle groove on which the other end of the member seating body is straddled; a fourth straddle groove on which the other end of the horizontal engaging element is straddled; and a second groove in which the other end of the angle-type steel-frame member is inserted.

The reinforcing bar may be a rectangular frame with a plurality of reinforcing holes to cross-connect the supporter and the horizontal engaging element.

In accordance with another aspect, the invention provides a method of fastening a reinforcement device for compression buckling strength, including: securing an angle-type steel-frame member and a member seating body to first and second securing couplers; and cross-securing a supporter and a horizontal engaging element to each other by positioning a reinforcing bar in the angle-type steel frame member.

The securing an angle-type steel-frame member and a member seating body to first and second securing couplers may include inserting and securing one end of the angle-type steel-frame member in a first groove of the first securing coupler by a first securing bolt; inserting and securing the other end of the angle-type steel-frame member in a second groove of the second securing coupler by a second securing bolt; inserting and securing one end of the member seating body in a first hole of the first securing coupler by a first round-bar engaging member; and inserting and securing the other end of the member seating body in a third hole of the second securing coupler by a third round-bar engaging member.

The securing an angle-type steel-frame member and a member seating body to first and second securing couplers may include using the first round-bar engaging member and the third round-bar engaging member to secure the member seating body while adjusting the member seating body to meet a standard of the angle-type steel-frame member.

BRIEF DESCRIPTION OF THE DRAWINGS

The above and other aspects, features and advantages of the invention will become apparent from the following description of exemplary embodiments given in conjunction with the accompanying drawings, in which.

DETAILED DESCRIPTION OF THE PREFERRED EMBODIMENTS

Hereinafter, exemplary embodiments of the present invention will be described in more detail with reference to FIGS. 2 to 6.

Figure 1:
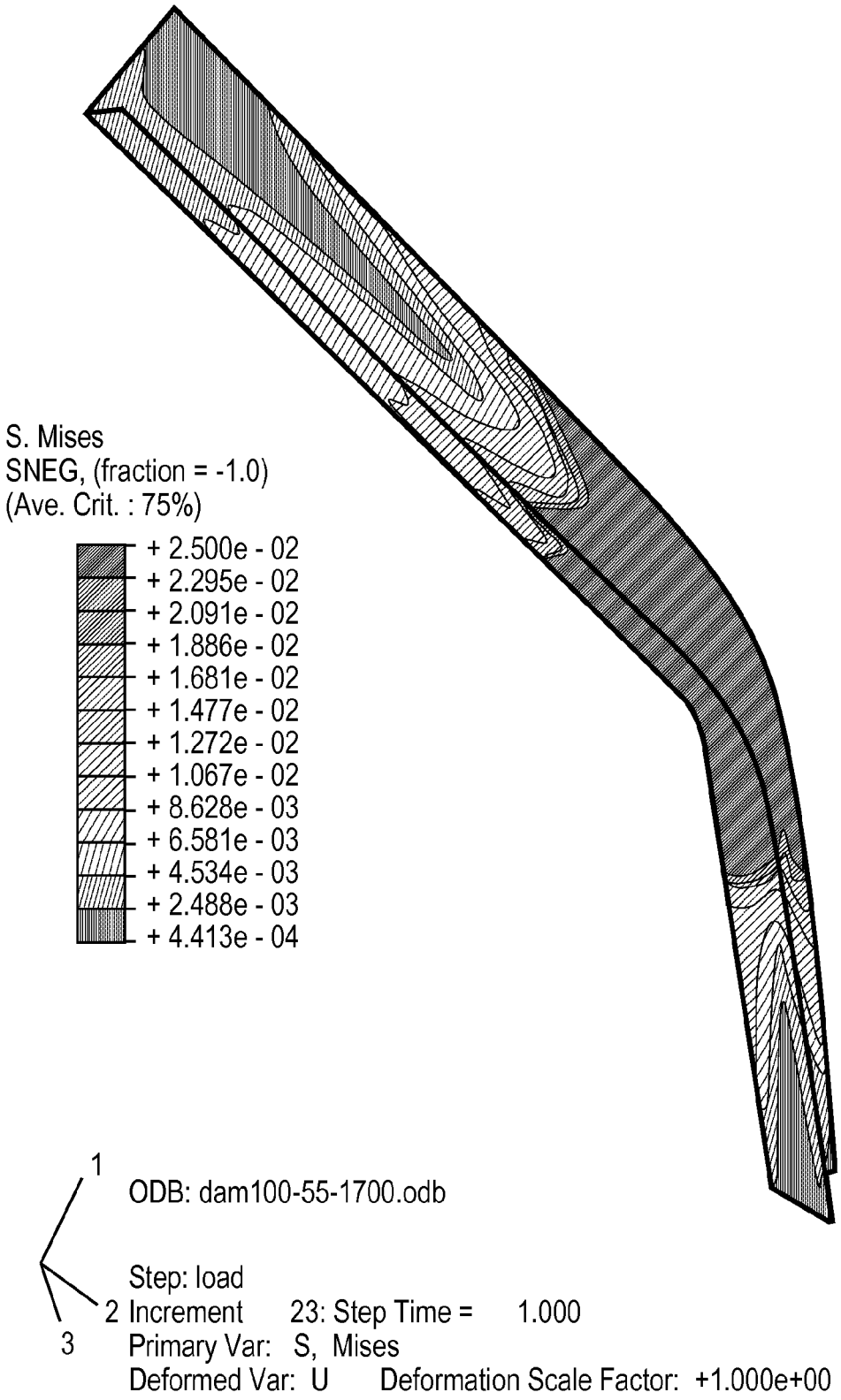
FIG. 1 shows buckling of an angle-type steel-frame member used in a conventional steel power-transmission tower or steel-frame structure.
Figure 2:
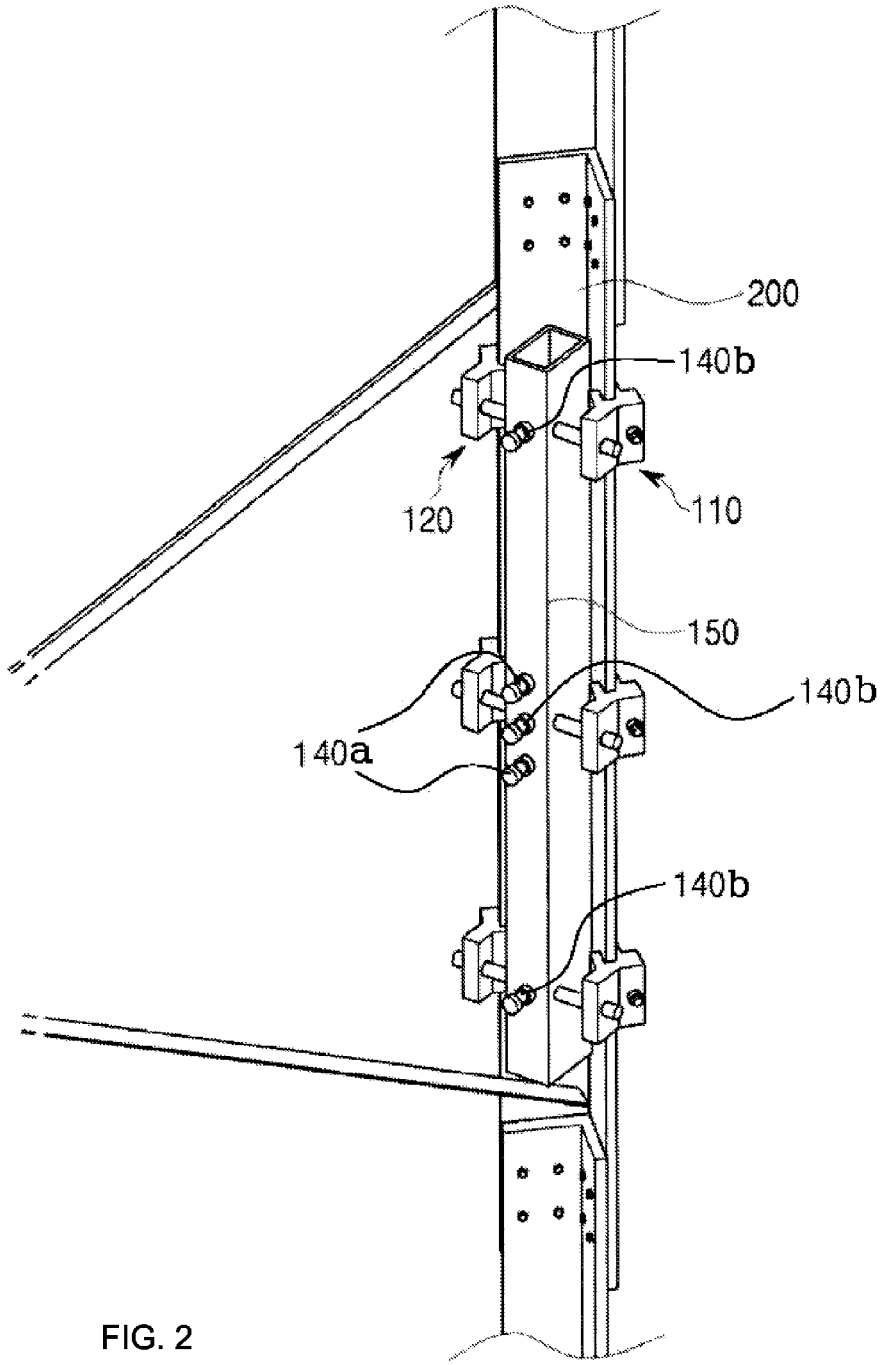
FIG. 2 is a perspective view of an angle-type steel-frame member provided with a reinforcement device for compression buckling strength according to one embodiment of the present invention.
Figure 3:
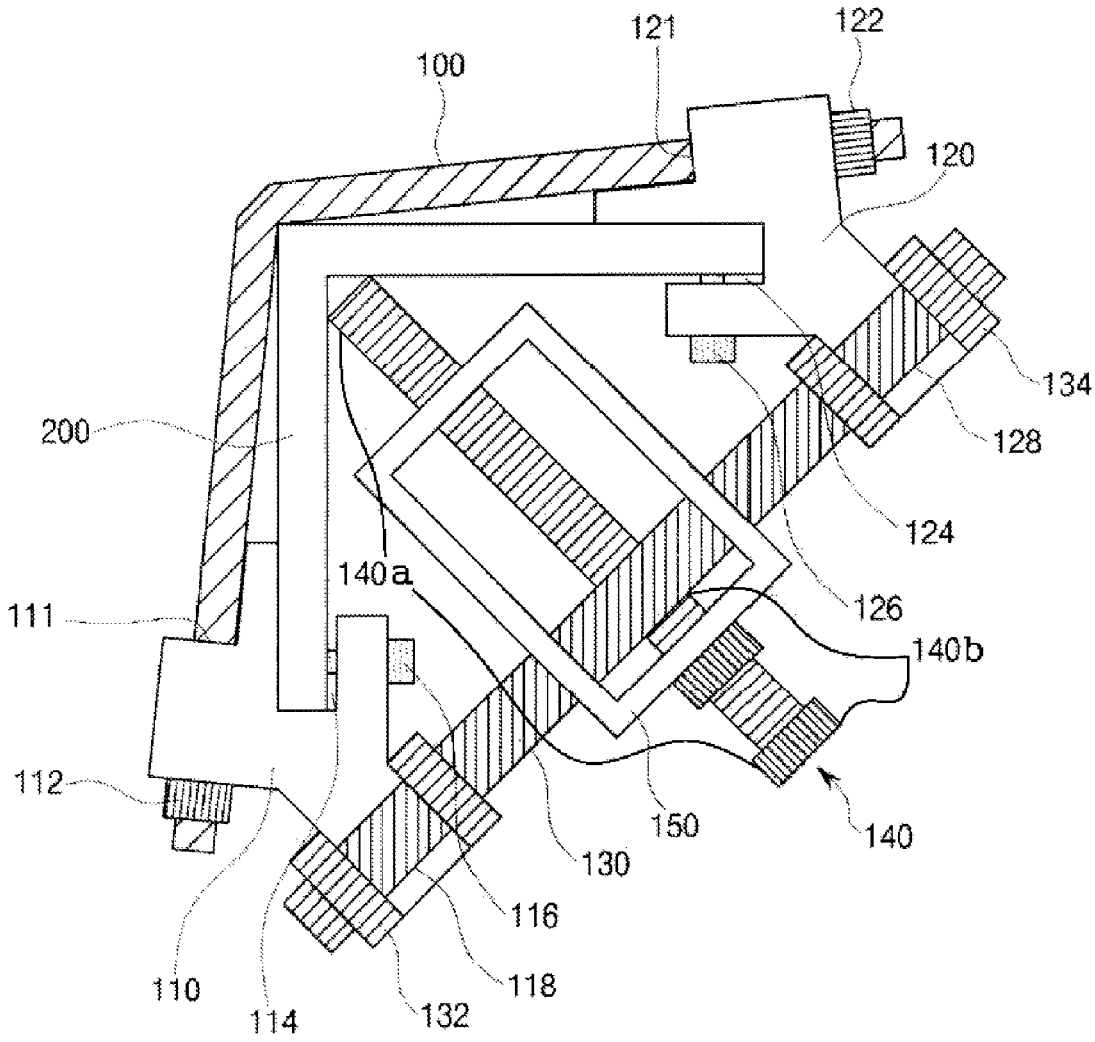
FIG. 3 is a detailed sectional view of the reinforcement device of FIG. 2.

FIG. 2 is a perspective view of an angle-type steel-frame member provided with a reinforcement device for compression buckling strength according to one embodiment of the invention, and FIG. 3 is a detailed sectional view of the reinforcement device of FIG. 2.

In general, a steel power-transmission tower has a truss structure, which is designed to connect steel-frame members triangularly and use tension and compressive force of the members to resist external force. The truss structure is believed to be effective against earthquakes since it enables construction of a lightweight and rigid structure. Here, an angle-type steel-frame member 200 is employed as the steel-frame member for the steel power-transmission tower having the truss structure and is also employed as a brace for resisting lateral force in a steel-frame structure. Further, the angle-type steel-frame member 200 includes a detachable reinforcement device for compression buckling strength, thereby preventing compression buckling and accidental eccentricity. To this end, the reinforcement device includes a member seating body 100 surrounding the angle-type steel-frame member 200; first and second securing couplers 110, 120 securing opposite ends of the angle-type steel-frame member 200 and opposite ends of the member seating body 100, and adjustable to meet a standard of the angle-type steel frame member 200; a horizontal engaging element 130 connecting the first and second securing couplers 110, 120 with each other; a supporter 140 positioned in a space where the angle-type steel-frame member 200 forms a right angle and supporting the angle-type steel-frame member 200; and a reinforcing bar 150 connecting the supporter 140 and the horizontal engaging element 130.

The member seating body 100 has an L-shape or an inverse-L shape to surround the angle-type steel-frame member 200, as shown in FIG. 3. The member seating body 100 may be a round-bar having an "L" or inverse-"L" shape. Here, the member seating body 100 is formed to have a larger angle than the angle-type steel-frame member 200.

The first securing coupler 110 includes a first hole 111 into which one end of the member seating body 100 is inserted and secured; a first groove 114 into which one end of the angle-type steel-frame member 200 is inserted and secured; and a second hole 118 into which one end of the horizontal engaging element 130 is inserted and secured. Here, the one end of the member seating body 100 is inserted into the first hole 111 of the first securing coupler 110 and secured thereto by a first round-bar engaging member 112; the one end of the angle-type steel-frame member 200 is inserted into the first groove 114 of the first securing coupler 110 and secured thereto by a first securing bolt 116; and the one end of the horizontal engaging element 130 is inserted into the second hole 118 and secured thereto by a second round-bar engaging member 132.

Here, the first groove 114 of the first securing coupler 110 is formed to have a size to receive the one end of the angle-type steel-frame member 200.

The second securing coupler 120 includes a third hole 221 into which the other end of the member seating body 100 is inserted and secured; a second groove 124 into which the other end of the angle-type steel-frame member 200 is inserted and secured; and a fourth hole 128 into which the other end of the horizontal engaging element 130 is inserted and secured. Here, the other end of the member seating body 100 is inserted into the third hole 221 of the second securing coupler 110 and secured thereto by a third round-bar engaging member 122; the other end of the angle-type steel-frame member 200 is inserted into the second groove 124 of the second securing coupler 120 and secured thereto by a second securing bolt 126; and the other end of the horizontal engaging element 130 is inserted into the fourth hole 128 and secured thereto by a fourth round-bar engaging member 134.

Here, the second groove 124 of the second securing coupler 120 is formed to have a size to receive the other end of the angle-type steel-frame member 200.

On the other hand, the one end of the member seating body 100 is inserted into the first hole 111 of the first securing coupler 110, and the other end of the member seating body 100 is then inserted into the third hole 221 of the second securing coupler 120. Then, the opposite ends of the member seating body 110 are adjusted to meet the standard of the angle-type steel-frame member 200 while being fastened by the first and third round-bar engaging members 112, 122.

The horizontal engaging element 130 may be an elongated round-bar to connect the first and second securing couplers 110, 120 with each other. The horizontal engaging element 130 is inserted into the first and second securing couplers 110, 120 while penetrating the reinforcing bar 150.

The supporter 140 has a rod shape and is positioned in a space where the angle-type steel-frame member 200 forms a right angle, and penetrates the reinforcing bar 150.

The supporter 140 includes an elongated member-fastening bolt 140*a* and a reinforcing-bar securing bolt 140*b* which is shorter than the member-fastening bolt 140*a*.

The reinforcing bar 150 is formed as a rectangular frame that has a plurality of reinforcing holes to cross-connect the supporter 140 and the horizontal engaging element 130.

Figure 6:
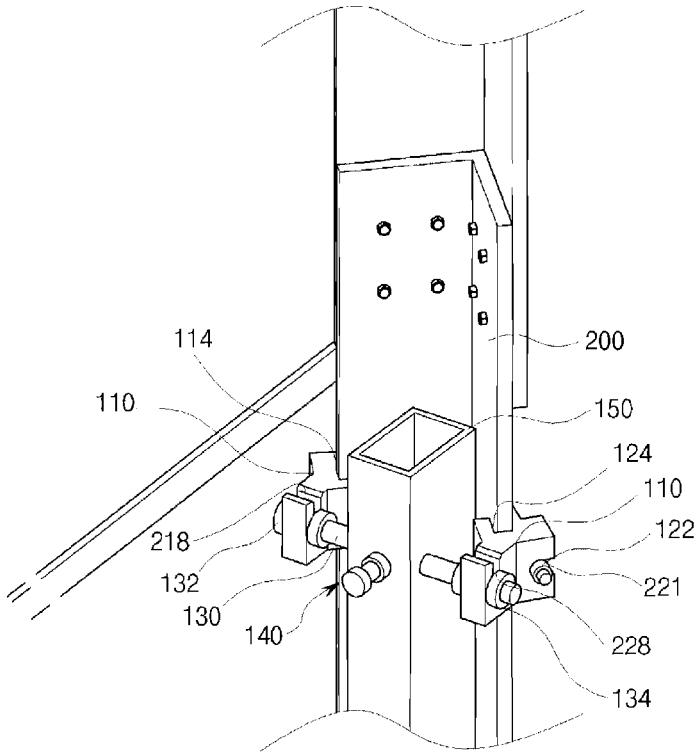
FIG. 6 is a perspective view of another example of first and second securing couplers according to an exemplary embodiment of the present invention.

On the other hand, the first and second securing couplers 110, 120 are formed with the first to fourth holes 111, 118, 121, 128 into which the member seating body 100 and the horizontal engaging element 130 are inserted and secured, respectively. Alternatively, as shown in FIG. 6, the first securing coupler 110 may be formed with a first straddle groove 211 on which the one end of the member seating body 100 is straddled, and a second straddle groove 218 on which the one end of the horizontal engaging element 130 is straddled.

Likewise, the second securing coupler 120 may be formed with a third straddle groove 211 on which the other end of the member seating body 100 is straddled, and a fourth straddle groove 228 on which the other end of the horizontal engaging element 130 is straddled.

Figure 4A:
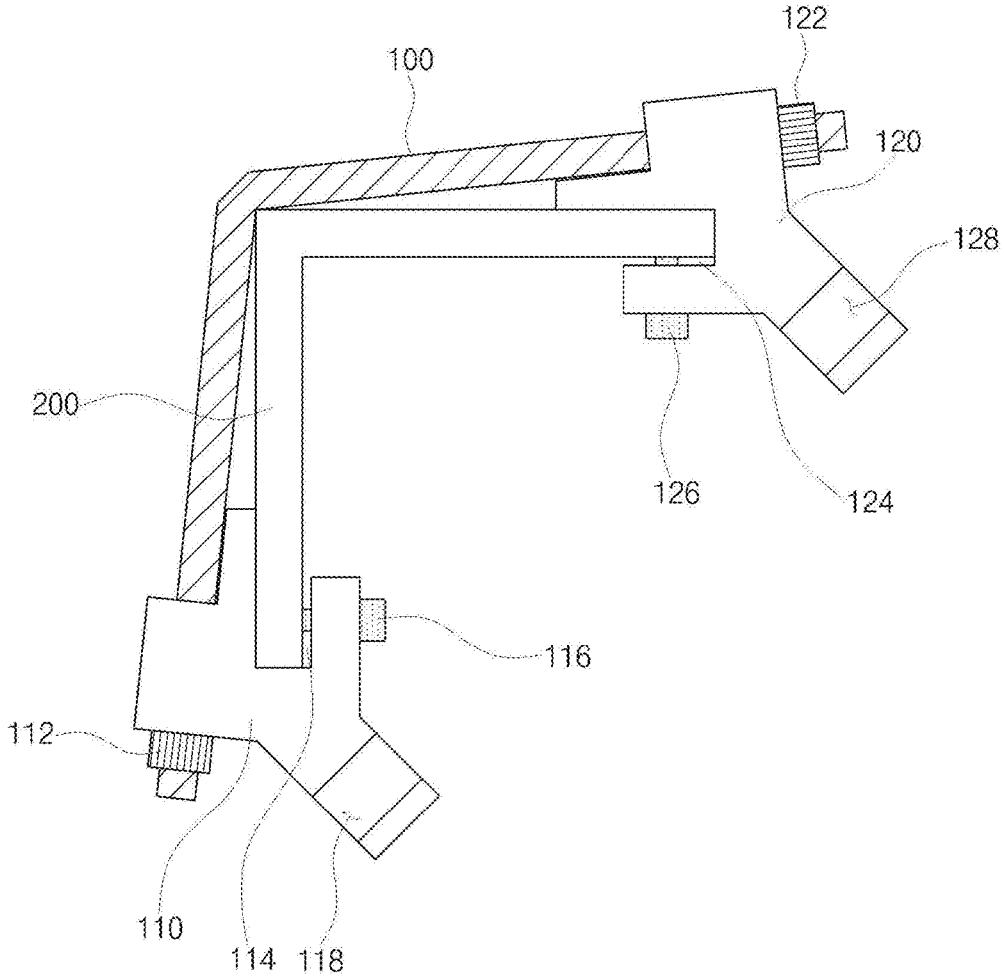
FIGS. 4A and 4B are sectional views of a method of fastening the reinforcement device of FIG. 3 to an angle-type steel-frame member.
Figure 4B:
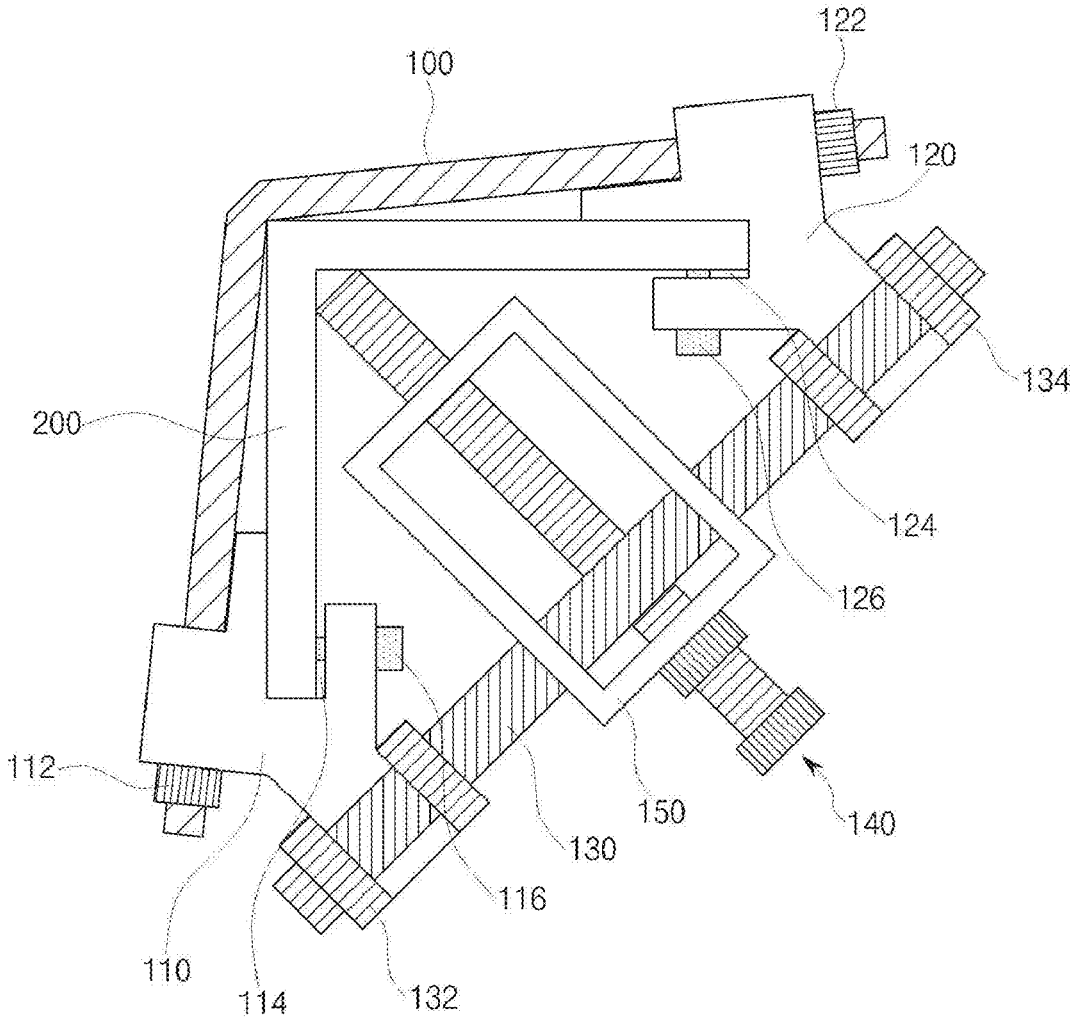

FIGS. 4A and 4B are sectional views of a method of fastening the reinforcement device of FIG. 3 to an angle-type steel-frame member.

In this embodiment, the method of fastening the reinforcement device includes: securing the angle-type steel-frame member 200 and the member seating body 100 to the first and second securing couplers 110, 210; and cross-securing the supporter 140 and the horizontal engaging element 130 to each other by positioning the reinforcing bar 150 in the angle-type steel frame member 200. As shown in FIG. 6, the first and second securing couplers 110, 120 may be formed with the first to fourth straddle grooves 211, 218, 221, 228. However, in this embodiment, the method will be described with reference to the embodiment wherein the first and second securing couplers 110, 120 are formed with the first to fourth holes 111, 118, 121, 128.

First, as shown in FIG. 4A, the one end of the angle-type steel-frame member 200 is inserted into the first groove 114 of the first securing coupler 110 and then secured thereby by the first securing bolt 116, and the other end of the angle-type steel-frame member 200 is inserted into the second groove 124 of the second securing coupler 120 and secured thereby by the second securing bolt 126. Further, the one end of the member seating body 100 is inserted into the first hole 111 of the first securing coupler 110 and secured thereto by the first round-bar engaging member 112, and the other end of the member seating body 100 is inserted into the third hole 221 of the second securing coupler 120 and secured thereto by the third round-bar engaging member 122. Here, the first round-bar engaging member 112 and the third round-bar engaging member 122 are used to secure the member seating body 100 while adjusting the member seating body 100 to meet the standard of the angle-type steel-frame member 200.

Then, as shown in FIG. 4B, the reinforcing bar 150 is positioned in the angle-type steel-frame member 200, so that the horizontal engaging element 130 and the supporter 140 can be secured while penetrating the reinforcing bar 150 via the plurality of reinforcing holes to cross with each other. Here, the one end of the horizontal engaging element 130 is inserted into the second hole 118 of the first securing coupler 110 and is secured thereto by the third securing bolt 132, and the other end of the horizontal engaging element 130 is inserted into the fourth hole 128 of the second securing coupler 120 and is secured thereto by the fourth securing bolt 134.

Figure 5:
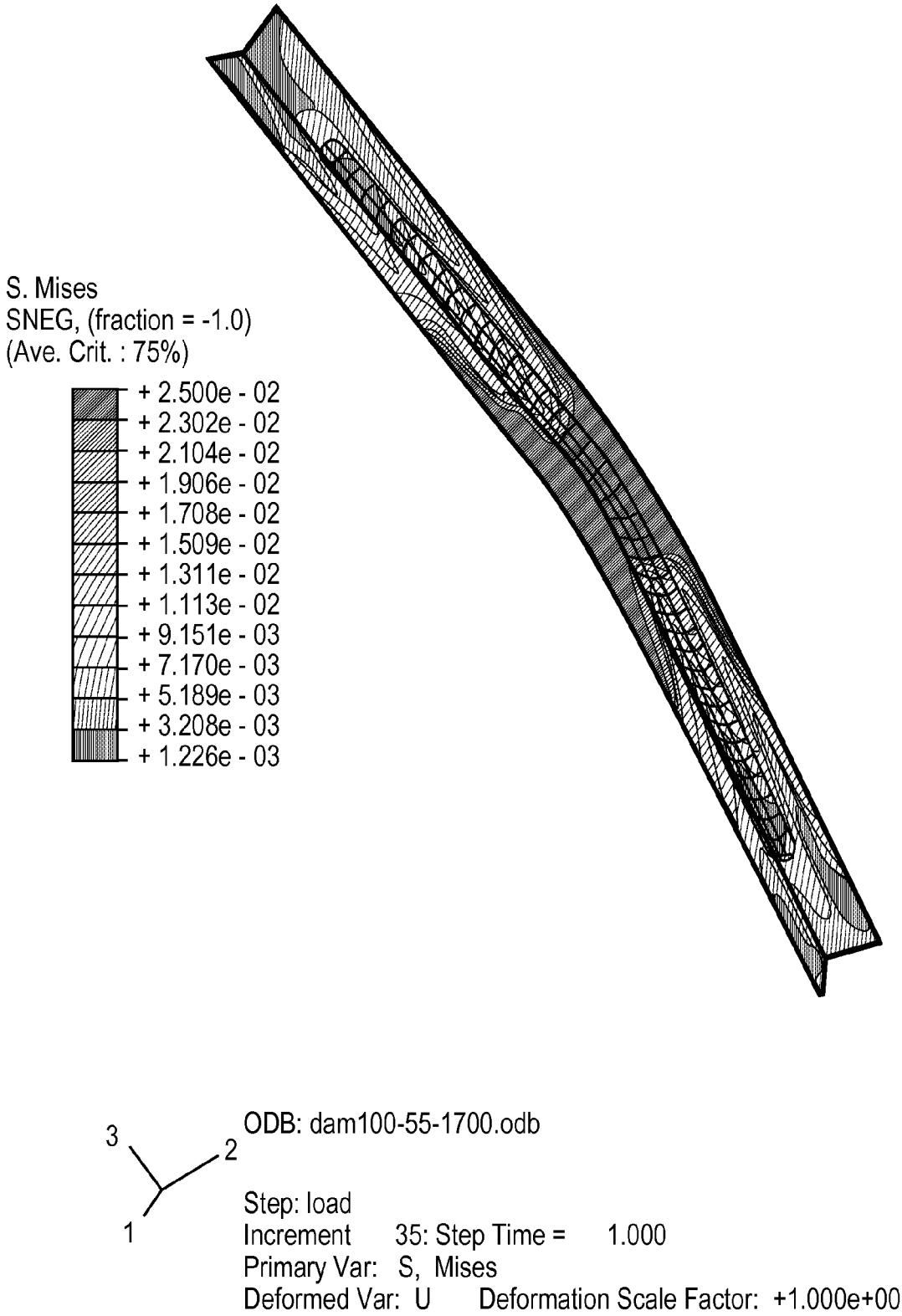
FIG. 5 shows that an angle-type steel-frame member is reinforced by a reinforcement device for compression buckling strength according to one embodiment of the present invention.

As such, the angle-type steel-frame member is reinforced by the reinforcement device for compression buckling strength, so that the compression buckling strength is enhanced as shown in FIG. 5, thereby preventing the angle-type steel-frame member from buckling. Further, the reinforcement device is detachably and simply mounted to the middle of the angle-type steel-frame member without power interruption of transmission lines, member disassembly or field preparation, thereby improving compression buckling strength of the angle-type steel-frame member.

That is, the reinforcement device according to this embodiment can improve the compression buckling strength of the angle-type steel-frame member by being detachably mounted to the angle-type steel-frame member. Since the reinforcement device is detachably mounted thereto, there is no need for power interruption of transmission lines, processing a bolt hole for coupling a reinforcing member, and disassembling the member.

Further, since the reinforce device according to the embodiment can be rapidly detachably mounted to a target structure for immediate reinforcement, it can be effectively used for safe operation of any structure or transmission line.

Although some embodiments have been provided to illustrate the invention, it will be apparent to those skilled in the art that the embodiments are given by way of illustration, and that various modifications and equivalent embodiments can be made without departing from the spirit and scope of the invention. Accordingly, the scope of the invention should be limited only by the accompanying claims and equivalents thereof.

What is claimed is:

1. A reinforcement device to enhance compression buckling strength of an angle-type steel-frame member used to construct a truss structure of a power-transmission tower, the reinforcement device comprising:

a member seating body to surround the angle-type steel-frame member and restrict the movement of opposite ends of the angle-type steel-frame member, wherein the member seating body is formed with a larger angle than the angle-type steel-frame member;

first and second securing couplers to secure opposite ends of the angle-type steel-frame member and opposite ends of the member seating body, respectively, wherein the first and second securing couplers are adjustable to receive the respective ends of the angle-type steel-frame member depending upon a dimension of the angle-type steel-frame member;

a horizontal engaging element formed in an elongated round-bar that connects the first and second securing couplers through securing bolts provided at opposite ends of the engaging element;

a supporter positioned in a space where the angle-type steel-frame member forms a right angle and supporting the angle-type steel-frame member, wherein the supporter includes an elongated member fastening bolt and a reinforcing-bar securing bolt that is shorter than the member fastening bolt; and a reinforcing bar positioned in a space formed by the angle-type steel-frame member to connect the supporter and the horizontal engaging element, wherein the elongated member fastening bolt of the supporter penetrates through the reinforcing bar to make contact with the angle-type steel-frame member.

2. The reinforcement device according to claim 1, wherein the member seating body has an L-shape or an inverse-L shape to surround the angle type steel-frame member.

3. The reinforcement device according to claim 1, wherein the first securing coupler comprises:

a first hole into which one end of the member seating body is inserted;

a second hole into which one end of the horizontal engaging element is inserted; and a first groove into which one end of the angle-type steel-frame member is inserted.

4. The reinforcement device according to claim 3, wherein the first securing coupler further comprises:

a first round-bar engaging member securing one end of the member seating body inserted into the first hole of the first securing coupler;

a second round-bar engaging member securing one end of the horizontal engaging element inserted into the second hole of the first securing coupler; and a first securing bolt securing one end of the angle-type steel-frame member inserted into the first groove of the first securing coupler.

5. The reinforcement device according to claim 1, wherein the first securing coupler comprises:

a first straddle groove on which one end of the member seating body is straddled;

a second straddle groove on which one end of the horizontal engaging element is straddled; and a first groove in which one end of the angle-type steel-frame member is inserted.

6. The reinforcement device according to claim 3, wherein the second securing coupler comprises:

a third hole into which the other end of the member seating body is inserted and secured;

a fourth hole into which the other end of the horizontal engaging element is inserted; and a second groove into which the other end of the angle-type steel-frame member is inserted.

7. The reinforcement device according to claim 6, wherein the first securing coupler further comprises:

a third round-bar engaging member securing one end of the member seating body inserted into the third hole of the second securing coupler;

a fourth round-bar engaging member securing one end of the horizontal engaging element inserted into the fourth hole of the second securing coupler; and a second securing bolt securing one end of the angle-type steel-frame member inserted into the second groove of the second securing coupler.

8. The reinforcement device according to claim 1, wherein the second securing coupler comprises:

a third straddle groove on which the other end of the member seating body is straddled;

a fourth straddle groove on which the other end of the horizontal engaging element is straddled; and a second groove in which the other end of the angle-type steel-frame member is inserted.

9. The reinforcement device according to claim 1, wherein the reinforcing bar is a rectangular frame having a plurality of reinforcing holes to cross connect the supporter and to the horizontal engaging element.

10. A method of fastening a reinforcement device to enhance compression buckling strength of an angle-type steel-frame member used to construct a truss structure of a power-transmission tower, the method comprising:

securing an angle-type steel-frame member and a member seating body to first and second securing couplers; and cross-securing a supporter and a horizontal engaging element to each other by positioning a reinforcing bar in a space formed by the angle-type steel frame member, wherein the securing the angle-type steel frame member and the member seating body to the first and second securing couplers includes inserting a first end of the angle-type steel-frame member into a first groove of the first securing coupler and securing the first end of the angle-type steel-frame member with a first securing bolt, inserting a second end of the angle-type steel-frame member into a second groove of the second securing coupler and securing the second end of the angle-type steel-frame member with a second securing bolt, inserting a first end of the member seating body into a first hole of the first securing coupler and securing the first end of the member seating body with a first round-bar engaging member, inserting a second end of the member seating body into a third hole of the second securing coupler and securing the second end of the member seating body with a third round-bar engaging member.

11. The method according to claim 10, wherein the securing, an angle-type steel-frame member and a member seating body to first and second securing couplers comprises using the first round-bar engaging member and the third round-bar engaging member to secure the member seating body while adjusting the member seating body to meet a standard of the angle-type steel-frame member.

* * * * *